United States Patent [19]

Greb et al.

[11] Patent Number: 5,028,847

[45] Date of Patent: Jul. 2, 1991

[54] LAUNCHER SUITABLE FOR EXCITING SURFACE WAVES IN A DISCHARGE TUBE

[75] Inventors: Ulrich Greb, Cossington; Neil A. Linden-Smith, Thurmaston, both of England

[73] Assignee: Thorn EMI plc, London, England

[21] Appl. No.: 401,417

[22] Filed: Sep. 1, 1989

[30] Foreign Application Priority Data

Sep. 2, 1988 [GB] United Kingdom ..... 8821673

[51] Int. Cl.[5] ..... H05B 41/16

[52] U.S. Cl. ..... 315/248; 315/111.21; 313/607

[58] Field of Search ..... 315/111.21, 111.51, 315/248, 39; 219/10.55 R; 313/607

[56] References Cited

U.S. PATENT DOCUMENTS 4,049,940 9/1977 Moisan ..... 315/111.21
4,473,736 9/1984 Bloyet ..... 315/111.21
4,715,054 12/1987 Kato ..... 315/111.21
4,792,728 12/1988 Leny ..... 315/111.21
4,906,898 3/1990 Moisan ..... 315/248

*Primary Examiner*—Eugene R. LaRoche
*Assistant Examiner*—A. Zarabian
*Attorney, Agent, or Firm*—Fleit, Jacobson, Cohn, Price, Holman & Stern

[57] ABSTRACT

A discharge tube arrangement includes a discharge tube of a light-transmissive dielectric material and containing a fill. An excitation device for exciting surface waves in the discharge tube comprises an r.f. power generator and a launcher. The launcher is formed as an inner tube, an outer tube coaxial with the inner tube, and first and second end walls, at least one of the first and second end walls having an aperture for receiving the discharge tube. Means are provided inside the launcher for coupling r.f. power to the inner tube. A body of dielectric material extends from the inner tube to the outer tube, thereby to hold the tubes in fixed relative positions, the body encasing the coupling means.

13 Claims, 4 Drawing Sheets

LAUNCHER SUITABLE FOR EXCITING SURFACE WAVES IN A DISCHARGE TUBE

This invention relates to a discharge tube arrangement and in particular, though not exclusively, to such an arrangement for use as a light source. In particular, this invention relates to a structure, known as a launcher, for such a discharge tube arrangement.

It is known, e.g. as disclosed in U.S. Pat. No. 4,049,940 (Moisan et al), to generate and sustain a discharge in a gas using electromagnetic surface waves. Surface waves are created by a launcher which is positioned around and external of, but not extending the whole length of, the discharge tube containing the gas. In such an arrangement, it is not necessary to provide electrodes inside the discharge tube. The power to generate the electromagnetic wave is provided by a radio frequency (r.f.) power generator.

M. Moisan and Z. Zakrzewski "New surface wave launchers for sustaining plasma columns at submicrowave frequencies (1–300 MHz)" Rev. Sci. Instrum 58 (10), Oct. 1987, disclose a launcher with an impedance-matching network to provide what is termed 'external matching' (as opposed to 'internal matching', which would be provided by the size and shape of the launcher.) A typical launcher for use with an impedance-matching network is shown in FIG. 1. The launcher 2 comprises an inner aluminum tube 4 and an outer aluminum tube 6 coaxial with the inner tube 4. One end of the outer tube 6 is closed by a steel plate 8. The inner tube 4 is shorter than the outer tube 6 and accordingly an annular launching gap 10 is defined between the end of the inner tube 4 and the steel plate 8. At the other end of the launcher, an aluminum metal plate 12 extends perpendicularly from the inner tube 4 towards the outer tube 6 almost closing that end of the launcher. An annular field arresting gap 14 between the outer edge of the plate 12 and the outer tube 6 confines the field existing between the inner and outer tube 4, 6. This gap allows a non-zero potential difference to be generated in the launching gap 10. A Teflon disc 15 adjacent the field arresting gap 14 holds the plate 12 and the inner tube 4 in position relative to the outer tube 6 and reduces, to a certain extent, the leakage of r.f. power from the field arresting gap 14. R.f. power is supplied to the launcher via connector 16 and an impedance matching network (not shown) consisting of inductors capacitors. The combination of the r.f. power generator, the impedance matching network and the launcher constitute an excitation device for the gas fill in the discharge tube.

A problem, particularly with such externally matched launchers, is that little support is provided to hold the inner tube in position.

It is an object of the present invention to provide a launcher which at least alleviates the problem outlined hereinbefore.

According to a first aspect of the present invention there is provided a launcher suitable, when energised, with radio frequency (r.f.) power, for exciting surface waves in a discharge tube containing a fill, the launcher comprising:

an inner tube;

an outer tube coaxial with said inner tube;

a first and second end wall, at least one of said first and second end walls having an aperture for receiving a said discharge tube;

a launching gap extending axially from a first end of said inner tube;

means, inside the launcher, for coupling r.f. power to said inner tube;

and a body of a dielectric material extending from said inner tube to said outer tube, thereby to hold said tubes in fixed relative positions, said body encasing said coupling means.

In a launcher as defined in accordance with the present invention, the body of dielectric material is a structural element holding the inner tube in position. This assists in defining and keeping constant the size of the launching gap. The body of dielectric material also assists in holding in position the coupling means which may optionally include components of an impedance matching network and may also include at least a part of an r.f. power generator.

Preferably said body extends from said first end wall to said second end wall and is contiguous with said inner tube. The dielectric material accordingly extends across the launching gap, helping to shape the electric field in that gap for ease of starting or other purposes.

Such advantages are particularly provided by a launcher manufactured in accordance with a second aspect of the present invention.

According to a second aspect of the present invention, there is provided a method of manufacturing a launcher suitable, when energised with r.f. power, for exciting surface waves in a discharge tube containing a fill, the method comprising the steps of:

forming a tubular body of dielectric material;

providing an inner, an outer, a first and a second end wall of electrically conductive material, said inner wall being surrounded by said tubular body, said outer wall being coaxial with said inner wall and at least one of said first and second end walls having an aperture for receiving a said discharge tube;

wherein said inner wall is adapted to be shorter than said tubular body whereby a launching gap is formed, extending axially from a first end of said inner wall to said first end wall.

As well as producing a launcher having all the advantages of the first aspect of the present invention, such a method of manufacture is convenient in production.

Embodiments of the invention will now be described, by way of example only, and with reference to the accompanying drawings in which.

and FIG. 8 shows stages in the formation of a launcher in accordance with the second aspect of the present invention.

Figure 1:
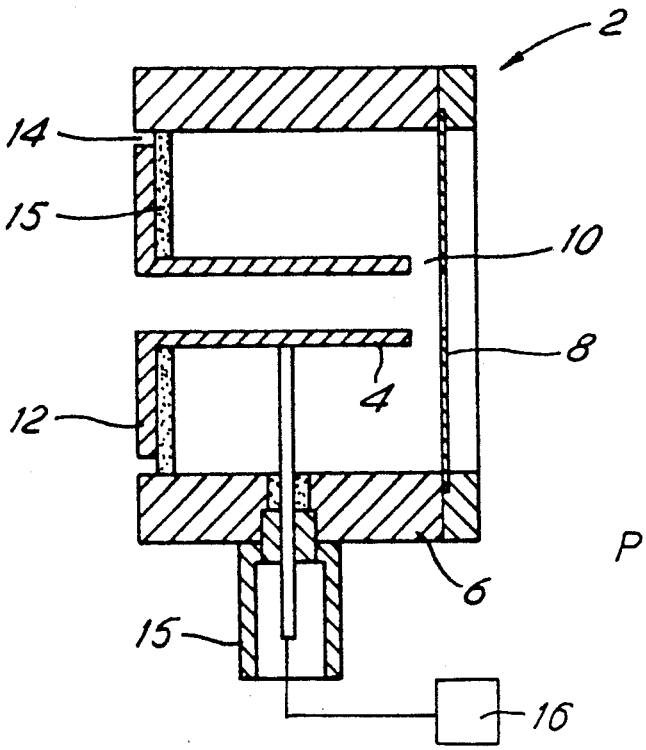
FIG. 1 PRIOR ART
FIG. 1 shows a cross-sectional side view of a known launcher as described hereinbefore.
Figure 2:
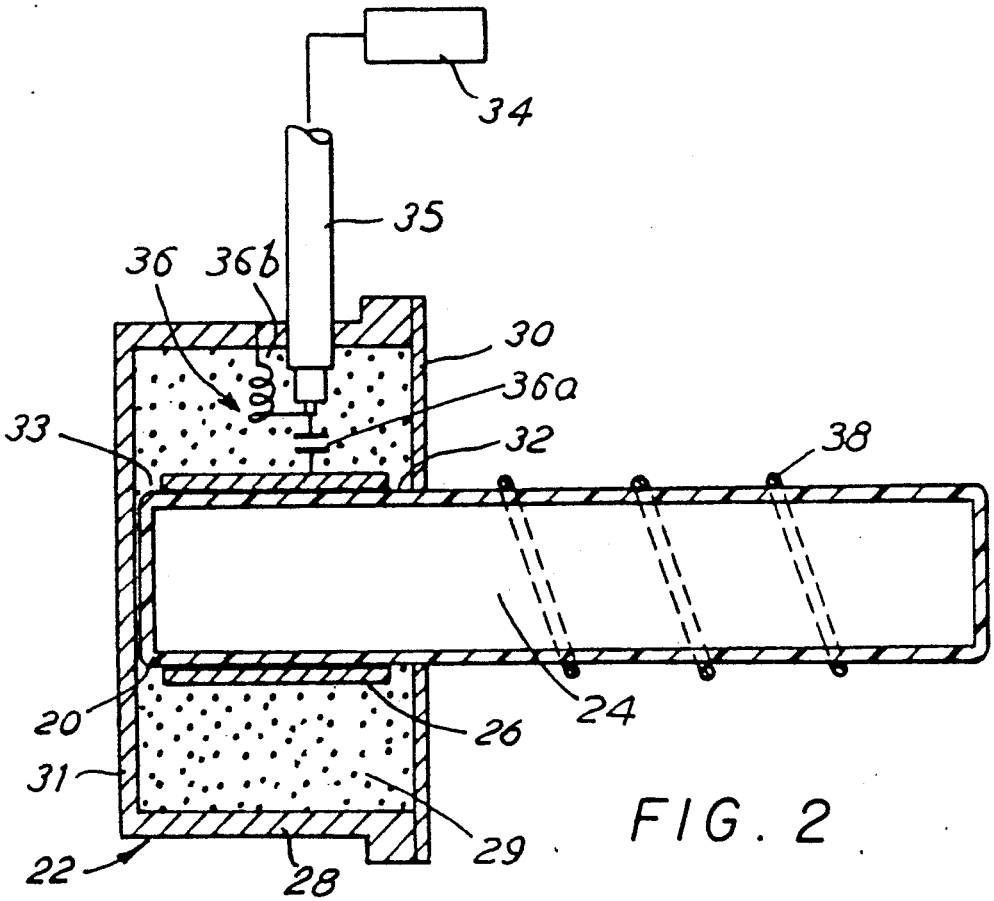
FIG. 2 shows a cross-sectional side view of a discharge tube arrangement incorporating a launcher provided in accordance with the present invention.

As shown in FIG. 2, a discharge tube arrangement comprises a discharge tube 20 mounted in a launcher 22. The discharge tube 20 is formed of a light-transmissive, dielectric material, such as glass, and contains a fill 24 of a noble gas, such as argon and an ionizable material, such as mercury.

The launcher 22 is made of an electrically conductive material, such as brass, and formed as a coaxial structure comprising an inner tube 26 and an outer tube 28 which provide an inner and an outer wall in between which is a body 29 of a dielectric materail. A first plate 30, at one end of the outer tube, provides a first end wall for the launcher structure. At the other end of the outer tube 28, a second plate 31, integral with the outer tube 28, provides a second end wall. The inner tube 26 is shorter than the outer tube 28 and so positioned within the outer tube 28 as to define a first annular gap 32 and a second annular gap 33. The first plate 30 has an aperture for receiving the discharge tube 20. The outer tube 28, the first plate 30 and the second plate 31 form an unbroken electrically conductive path around, but not in electrical contact with, the inner tube 26 to provide an r.f. screening structure therearound.

Suitable dimensions for the launcher of FIG. 2 are as follows:

Launcher length: 7–20 mm.

Launcher diameter (outer tube 28 diameter): 25–35 mm but depends on size of discharge tube 20.

Inner tube 26 length: 3–8 mm

Inner tube 26 diameter: 13 mm but depends on size of discharge tube 20.

Length of launching gap (first 10 gap 32); 0.5–3 mm

Length of second gap 33: 1–10 mm.

The thickness of the electrically conductive material is of the order of millimeters, or less, depending on the construction method used.

The body 29 of dielectric material fills a cavity defined by the inner tube 26, outer tube 28, and plates 30 and 31 and, as a structural element, holds the inner tube 26 in position relative to the outer tube 28, inter alia, defining and keeping constant the size of the gaps 32, 33. Suitable dielectric materials which exhibit low loss at r.f. frequencies include glass, quartz and PTFE (polytetrafluoroethylene) and some foams and resins. The dielectric material also helps in shaping the electric field in the gaps 32, 33 for ease of starting or other purposes.

Means for coupling r.f. power to the inner tube 26 comprise an r.f. power generator 34 (shown schematically) electrically coupled to the inner tube 26 via a coaxial cable 35 and an impedance matching network 36 (shown schematically) consisting of capacitors **36*a* and inductors 36*b*. That part of the coaxial cable 35 positioned inside the launcher 22 is held in position by the body 29 of dielectric material. The r.f. power generator 34, the impedance matching network 36, the coaxial cable 35 and the launcher 22** constitute an r.f. powered excitation device to energise the gas fill to produce a discharge.

When the r.f. power generator 34 is switched on, an oscillating electric field, having a frequency typically in the range of from 1 MHz to 1 GHz, is set up inside the launcher 22. At the first and second gaps 32, 33, this electric field is parallel to the longitudinal axis of the discharge tube 20. If sufficient power is applied, the consequent electric field produced in the gas fill 24 is sufficient to ionise the mercury to create a discharge through which an electromagnetic surface wave may be propagated in a similar manner to the arrangement of U.S. Pat. No. 4,049,940. Accordingly, the launcher 22 powered by the r.f. power generator 34 creates and sustains a discharge in the gas fill—the length and brightness of the discharge depending, inter alia, on the size of the discharge tube 20 and the power applied by the r.f. power generator 34. Such a discharge tube arrangement may therefore be used as a light source.

In the embodiment of FIG. 2, the first gap 32 and the second gap 33 each extend axially from respective ends of the inner tube 26, respectively to the first plate 30 and second plate 31. The discharge tube 20 extends from one end of the launcher 22 and so the first gap 32 is effective as a launching gap to create a discharge. The second gap 33 complements the effect of the first gap 32 and is advantageously larger than the first gap 32.

Figure 3:
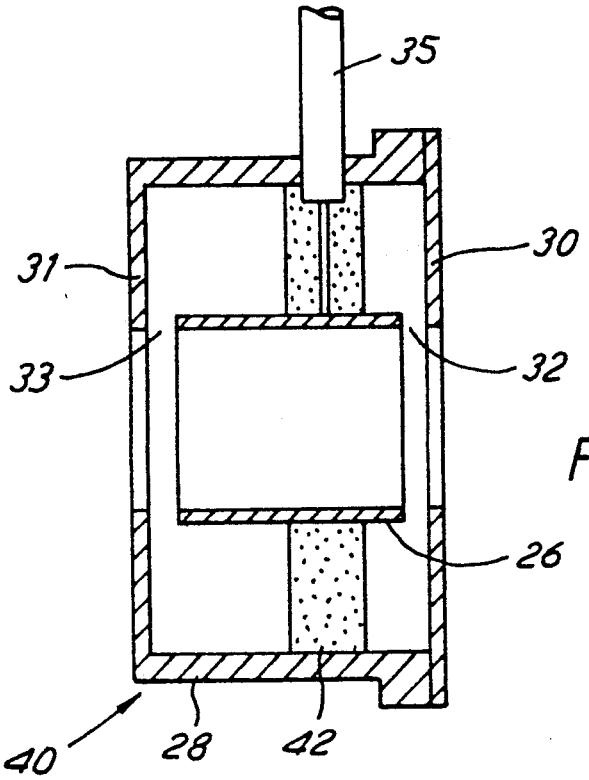
FIGS. 3 to 7 show cross-sectional side views of alternative embodiments of a launcher provided in accordance with the present invention.
Figure 4:
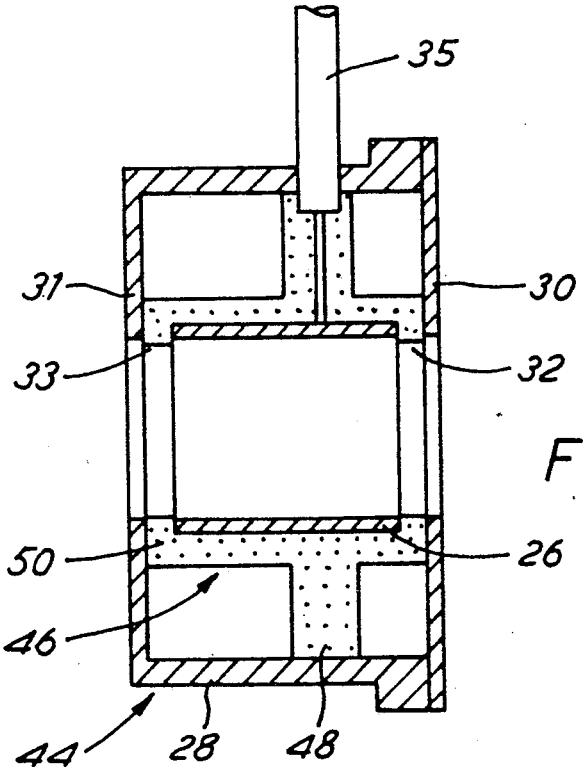
Figure 5:
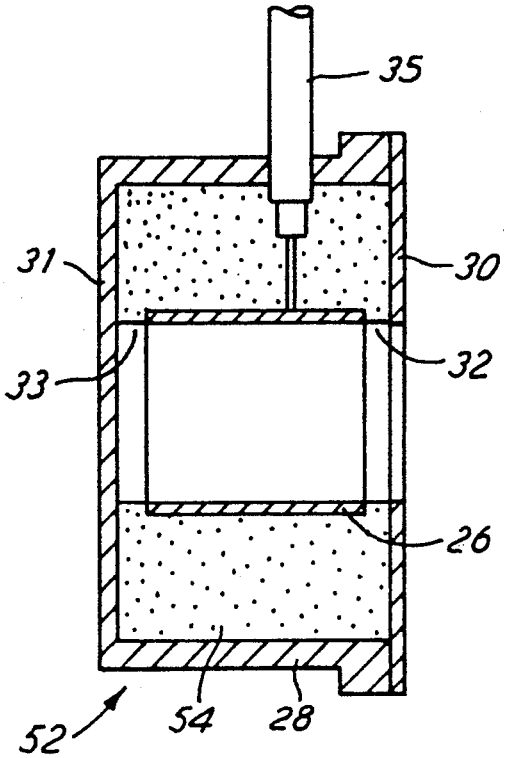
Figure 6:
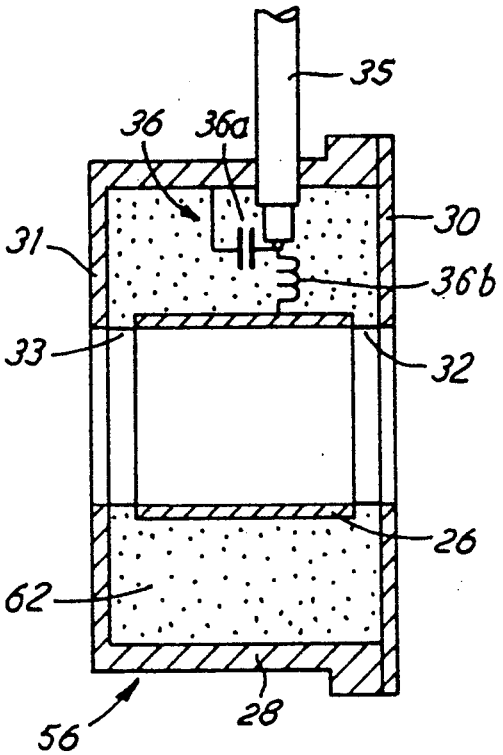

FIGS. 3 to 6 show alternative embodiments of a launcher provided in accordance with the present invention. These launchers are formed as a coaxial structure in a similar manner to the launcher 22 of FIG. 2 and accordingly like parts are designated by the like reference numerals. The embodiments of FIGS. 3 and 6 are shown as being provided with an aperture in the second plate 33. Accordingly, a discharge tube can be positioned to extend from both sides of the launcher. When power is supplied, both the first gap 32 and second gap 33 are effective as launching gaps to create a discharge. If the first and second gaps 32, 33 are the same size, this results in a relatively symmetrical discharge. As with the embodiment of FIG. 2, the r.f. power at the second gap 33 is dissipated in the discharge and not lost from the system as in prior art launchers.

In the launcher 40 of FIG. 3, the body of dielectric material is provided simply as an element 42 extending from the inner tube 26 to the outer tube 28 and encasing part of the coaxial cable 35. Such an element 42 holds in position the inner tube and that part of the coaxial cable 35 inside the launcher. The element 42 in one embodiment is an annular disc, possibly with holes therein.

FIG. 4 shows a launcher 44 in which the body 46 of dielectric material comprises an integral body having a disc-like part 48 and a cylindrical part 50. The disc-like part 48 extends radially from the inner tube 26 to the outer tube 28 and encases that part of the coaxial cable 35 inside the launcher. Part 50 of dielectric material extends from the plate 30 to the plate 31 and is contiguous with the inner tube 16. Accordingly, dielectric material is present in the gaps 32, 33, helping to shape the electric field therein for ease of starting or other purposes.

The launcher 52 of FIG. 5 includes a body 54 of dielectric material which holds in position the inner tube 26 and that part of the coaxial cable 35 inside the launcher.

FIG. 6 shows a launcher 56 in which the impedance matching network 36 (shown schematically) consisting of capacitors **36*a* and inductors 36*b* is provided inside the launcher —the coaxial cable 38 being connected directly to the r.f. power generator 34—thus providing a more compact light source than the embodiments of FIGS. 3 to 5. It is also envisaged that part or all of the r.f. power generator may be positioned inside the launcher. A body 62 of dielectric material assists in holding in position the inner tube 26 and means, inside the launcher, for coupling r.f. power to the inner tube 26 comprising the capacitors 36*a*, inductors 36*b* and that part of the coaxial cable 35** inside the launcher.

Figure 7:
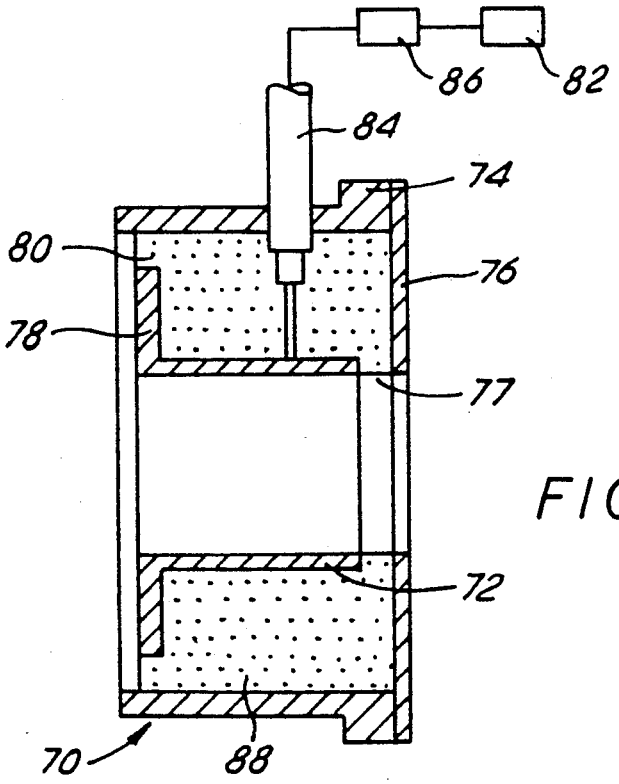
Figure 8A:
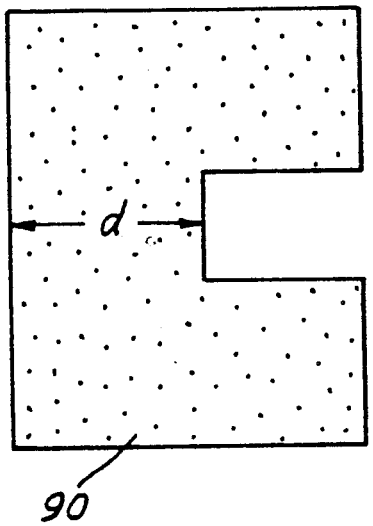
Figure 8B:
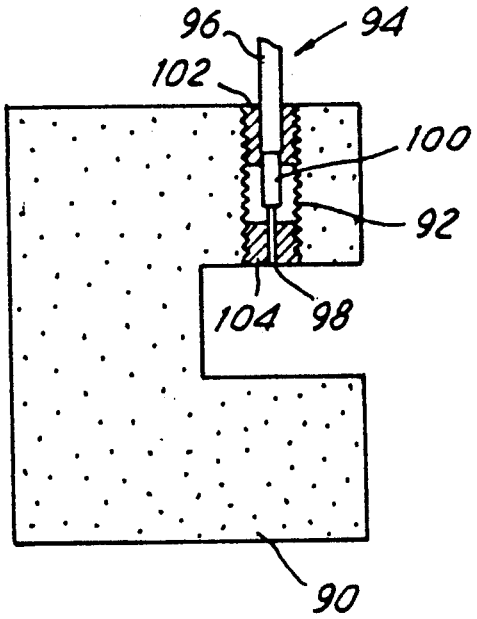
Figure 8C:
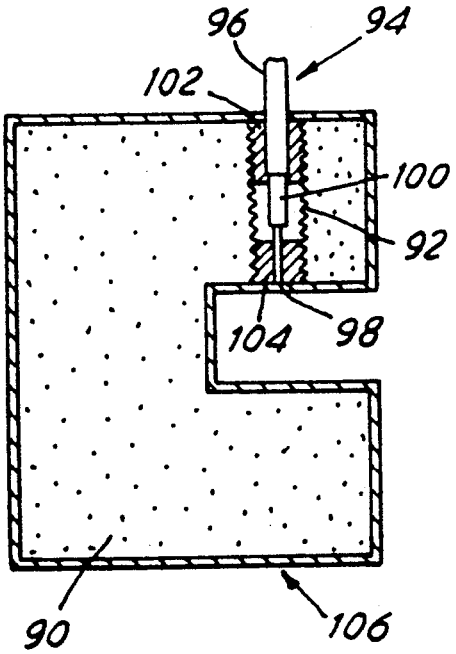
Figure 8D:
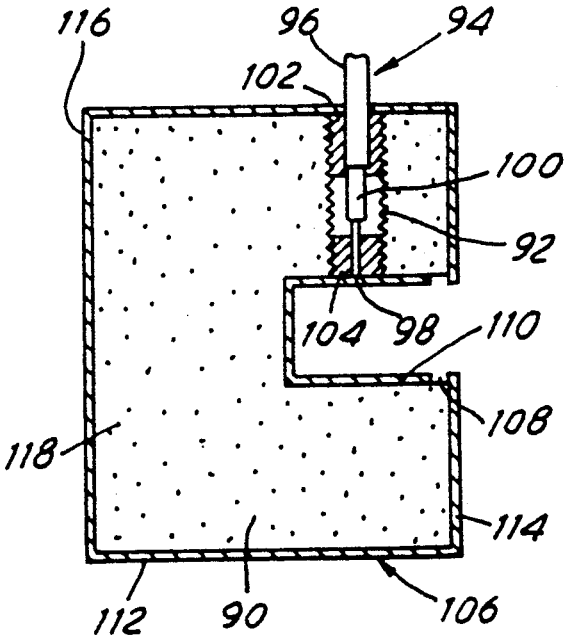

FIG. 7 shows yet another embodiment of a launcher 70 provided in accordance with the present invention. The launcher 70 is made of an electrically conductive material, such as brass, and is formed as a coaxial structure comprising an inner tube 72 and an outer tube 74. A first plate 76 at one end of the outer tube 74 provides a first end wall for the launcher structure. The inner tube 72 is shorter than the outer tube 74 and accordingly an annular launching gap 77 is defined between the end of the inner tube 72 and the first plate 76. A second end wall is provided at the other end of the launcher structure by an annular flange 78 integral with and extending from the inner tube 72 towards the outer tube 74. The flange 78 does not meet the outer tube 74, there being an annular field arresting gap 80 between the outer edge of the flange 78 and the outer tube 74.

As with the embodiment of FIG. 2, means to couple r.f. power to the inner tube of the launcher comprise an r.f. power generator 82 (shown schematically) electrically connected to the launcher 70 via a coaxial cable 84 and an impedance matching network 86 (shown schematically). The r.f. power generator 82, the impedance matching network 86, the coaxial cable 84 and the launcher 70 constitute an r.f. powered excitation device for exciting surface waves in a gas filled discharge body in a similar manner to the arrangement of U.S. Pat. No. 4,049,940. A body of a dielectric material fills a cavity defined by the inner tube 72 with flange 78, the outer tube 74 and the plate 76. As a structural element, this body 88 holds in position the inner tube 72 and that part of the coaxial cable 84 inside the launcher relative to the outer tube 74.

In the embodiments shown, the body of dielectric material has been used either just as a structural element to hold the inner tube and the electrical components inside the launcher in position relative to the outer tube and to keep the gap size constant or, in addition, to help in shaping the field in the launching gap for ease of starting or other purposes. The use of a dielectric material also affects the impedance of the launcher and hence the components required for external matching. Internally matched launchers incorporating an element of a dielectric material in accordance with the present invention could, when used at high frequencies, have an acceptable size.

It is further envisaged that a launcher can be manufactured using dielectric material as structural material for parts or the whole of the launcher body. The formed tubular body of dielectric material can then be coated, e.g. by electroplating, sputtering, evaporation and electrolytic deposition, or otherwise provided with a layer of an electrically conductive material as required to form the coaxial structure of the launcher. Suitable electrically conductive materials include copper and aluminum. The technique used for coating would depend on the material used. Alternatively, the inner and outer tubes of the launcher can be preformed tubes of electrically conductive material which can be slid onto the formed body of dielectric material.

One proposed method comprises the steps of:

1. Turning a dielectric material to form a tubular body;
2. Inserting a coaxial cable into the tubular body;
3. Applying a layer of an electrically conductive material to the dielectric body, so that the layer also connects to an end of the coaxial cable;
4. At appropriate points, turning the layer off the dielectric body to produce annular gaps.

In an alternative proposed method, steps (2) and (3) are interchanged. Accordingly such a method would include the further step of connecting an end of the coaxial cable with the layer by a suitable technique, such as soldering.

A method of manufacturing a launcher is shown in FIG. 8. As shown in FIG. 8*a*, a tubular body 90 of a dielectric material is formed having at one end an end wall of thickness d. This thickness d defines the size of one of the annular gaps in the finished launcher. In FIG. 8*b*, a threaded hole 92 has been provided in the launcher to take a coaxial cable 94 included in a connector assembly. The connector assembly comprises the coaxial cable 94 having an outer conductor 96, an inner conductor 98 coaxial with the outer conductor 96 and a dielectric material 100 separating the two conductors 96, 98; an outer threaded stud 102 around and soldered to the outer conductor 96; and an inner threaded stud 10 around and fixed to the inner conductor 98. FIG. 8*c* shows a coating 106 of an electrically conductive material such as aluminum which has been applied to the surface of the tubular body 90. The coating is applied as a conductive foil or by a process such as vacuum coating. The coating is electrically connected to the outer and inner threaded studs 102, 104. FIG. 8*d* shows the finished launcher. At one open end of the structure, a region of coating has been turned off the dielectric material 90 to form an annular launching gap 108. This gap 108 also separates the inner tube 110 from the combination of the outer tube 112, the first end wall 114 and the second end wall 116 which form an r.f. screening structure around the inner tube 110. As indicated hereinbefore, a gap 118 other than the launching gap 108 is defined by the end wall of the dielectric material.

In the case where the coating applied is very thin, a protective lacquer can also be applied.

Other modifications to the embodiments described herein and within the scope of the present invention will be apparent to those skilled in the art. In particular, it is envisaged that launcher structures need not be limited to those in which both the inner and the outer tube are of circular cross-section. The inner and outer tubes could be of non-circular but similar cross-section or could be dissimilar cross-section.

We claim:

1. A launcher suitable, when energised with radio frequency (r.f.) power, for exciting surface waves in a discharge tube containing a fill, the launcher comprising:

an inner tube;

an outer tube coaxial with said inner tube;

a first and second end wall, at least one of said first and second end walls having an aperture for receiving a said discharge tube;

a launching gap extending axially from a first end of said inner tube;

means, inside the launcher, for coupling r.f. power to said inner tube;

and a body of a dielectric material extending from said inner tube to said outer tube, thereby to hold said tubes in fixed relative positions, said body encasing said coupling means.

2. A launcher according to claim 1 wherein said body extends from said first end wall to said second end wall and is contiguous with said inner tube.

3. A launcher according to claim 2 wherein said body fills a cavity defined by said inner and outer tubes and said first and second end walls.

4. A launcher according to claim 1 wherein said dielectric material is selected from the group comprising quartz, glass and polytetrafluoroethylene.

5. A launcher according to claim 1 wherein said inner and said outer tubes have similar cross sections.

6. A launcher according to claim 1 wherein at least one of said inner and outer tubes has a circular cross-section.

7. An excitation device for exciting surface waves in a discharge tube containing a fill, the excitation device comprising a launcher according to claim 1 and an r.f. power generator.

8. A discharge tube arrangement comprising an excitation device according to claim 7 and a discharge tube made of a light transmissive dielectric material and containing a fill.

9. A method of manufacturing a launcher suitable, when energised with r.f. power, for exciting surface waves in a discharge tube containing a fill, the method comprising the steps of:

forming a tubular body of dielectric material;

providing an inner, an outer, a first and second end wall of electrically conductive material, said inner wall being surrounded by said tubular body, said outer wall being coaxial with said inner wall and at least one of said first and second end walls having an aperture for receiving a said discharge tube;

wherein said inner wall is adapted to be shorter than said tubular body whereby a launching gap is formed, extending axially from a first end of said inner wall to said first end wall.

10. A method according to claim 9 wherein the step of providing an inner wall comprises the step of coating a first surface of said dielectric material with electrically conductive material.

11. A method according to claim 9 wherein the step of providing an outer wall comprises the step of coating a second surface of said dielectric material with electrically conductive material.

12. A method according to claim 9 wherein the step of providing a first and second end wall comprises the step of coating first and second ends of the dielectric material with electrically conductive material.

13. A method according to claim 9 wherein a second gap is defined by an end wall of said tubular body of dielectric material.

* * * * *